US005672580A

United States Patent [19]

Donker et al.

[11] Patent Number: 5,672,580

[45] Date of Patent: Sep. 30, 1997

[54] LIQUID DETERGENT COMPOSITIONS

[75] Inventors: Cornelis Bernard Donker, Caldy; David Machin, Oxton, both of Great Britain; Frederik Jan Schepers, Vlaardingen, Netherlands

[73] Assignee: Lever Brothers Company, Division of Conopco, Inc., New York, N.Y.

[21] Appl. No.: 620,521

[22] Filed: Mar. 22, 1996

Related U.S. Application Data

[62] Division of Ser. No. 286,582, Aug. 5, 1994, abandoned.

[30] Foreign Application Priority Data

| | | | |
|---|---|---|---|
| Apr. 25, 1990 | [EP] | European Pat. Off. | 90304440 |
| Nov. 14, 1990 | [EP] | European Pat. Off. | 90312402 |

[51] Int. Cl.[6] ..... C11D 3/37; C11D 11/00

[52] U.S. Cl. ..... 510/417; 510/426; 510/430; 510/340

[58] Field of Search ..... 510/340, 426, 510/430, 417

[56] References Cited

U.S. PATENT DOCUMENTS

| | | | |
|---|---|---|---|
| 4,853,143 | 8/1989 | Hardy et al. | 252/102 |
| 5,147,576 | 9/1992 | Montague et al. | 252/174 |

FOREIGN PATENT DOCUMENTS

| | | |
|---|---|---|
| 0346993 | 12/1989 | European Pat. Off. . |
| 0346994 | 12/1989 | European Pat. Off. . |

*Primary Examiner*—Paul Lieberman
*Assistant Examiner*—Necholus Ogden
*Attorney, Agent, or Firm*—Ronald A. Koatz

[57] ABSTRACT

An aqueous liquid detergent composition comprising a primary alkyl sulphate material, which is present in a non-solid dispersed phase.

7 Claims, No Drawings

LIQUID DETERGENT COMPOSITIONS

This is a Divisional application of Ser. No. 08/286,582, filed Aug. 5, 1994, now abandoned.

The present invention is concerned with aqueous liquid detergent compositions which contain a primary alkyl sulphate material. More preferably the present invention relates to aqueous liquid detergent compositions which contain a primary alkyl sulphate (PAS) material, optionally in combination with other detergent-active materials and, optionally, sufficiently dissolved electrolyte to result in a structure of lamellar droplets dispersed in a continuous aqueous phase.

Primary alkyl sulphates are anionic surfactant materials, which are especially preferred for use in detergent compositions for environmental reasons.

A problem in the formulating of liquid detergent compositions comprising a primary alkyl sulphate as detergent active material is sometimes the occurrence of high viscosities and/or instability after storage.

It has now been found, that liquid detergent compositions comprising a primary alkyl sulphate material and having satisfactory stability and/or viscosity properties can be obtained by ensuring that the primary alkyl sulphate is present in a non-solid phase dispersed in the system.

Accordingly, the present invention relates to an aqueous liquid detergent composition comprising a primary alkyl sulphate material, which is present in a non-solid dispersed phase.

Preferably compositions of the invention are structured liquid detergent compositions. Structuring is especially preferred for providing physical stability to PAS containing compositions. Structured compositions according to the invention may be externally structured (the structuring is provided by materials other than the main active materials) or internally structured (the structuring is provided by main active materials, e.g. detergent active materials in combination with electrolytes). Preferably compositions of the invention are internally structured, more preferably compositions of the invention comprise an internal structure of lamellar droplets of detergent active material, dispersed in the aqueous phase of the composition.

Lamellar droplets are a particular class of surfactant structures which, inter alia, are already known from a variety of references, e.g. H. A. Barnes, 'Detergents', Ch.2. in K. Walters (Ed), 'Rheometry: Industrial Applications', J. Wiley & Sons, Letchworth 1980.

Such lamellar droplet systems are used to endow properties such as consumer-preferred flow behaviour and/or turbid appearance. Many are also capable of suspending particulate solids such as detergency builders or abrasive particles. Examples of such structured liquids without suspended solids are given in U.S. Pat. No. 4,244,840, whilst examples where solid particles are suspended are disclosed in specifications EP-A-160 342; EP-A-38 101; EP-A-104 452 and also in U.S. Pat. No. 4,244,840. Others are disclosed in European Patent Specification EP-A-151 884, where the lamellar droplets are called 'spherulites'.

The presence of lamellar droplets in a liquid detergent product may be detected by means known to those skilled in the art, for example optical techniques, various rheometrical measurements, X-ray or neutron diffraction, and electron microscopy.

The droplets consist of an onion-like configuration of concentric hi-layers of surfactant molecules, between which is trapped water or electrolyte solution (aqueous phase).

The Primary Alkyl Sulphate

Compositions of the invention comprise as part or all of the detergent active materials a PAS material, preferably a $C_8$ to $C_{20}$ PAS, more preferably a $C_9$ to C15 PAS, most preferably a $C_{10}$ to $C_{14}$ PAS. Suitable materials can for example be made by sulphating primary alcohols or are for example available under the trade names Lial 125 ex Enichem, Dobanol 25 ex Shell, Empicol LX ex Albright and Wilson and Texapon LS ex Henkel.

The level of PAS material is preferably from 0.1 to 40% by weight of the composition, more preferred from 3 to 20%, most preferably from 5 to 15%.

The PAS is present in a non-solid dispersed phase. For the purpose of the present invention this means that the PAS material is wholly or predominantly present in a non-solid dispersed phase. Preferably no or only minor amounts (less than 10%, more preferably less than 5%) of the PAS are present in the form of solid crystallites, also preferably no or only minor amounts (less than 10%, more preferably less than 5%) of the PAS are present in solubilised or micellar form.

The level of PAS in the form of crystallites can be estimated by light microscopy, the level of PAS in solubilised or micellar form can be estimated by centrifuging the composition at 750 G for 16 hours and then determining the level of PAS in the clear layer.

Preferably the PAS is predominantly (for more than 80% by weight, more preferably more than 90%, most preferably more than 95%) incorporated in a non-solid dispersed phase. Examples of non-solid dispersed phases are liquid crystal structures, for example lamellar droplet structures. Most preferably the PAS is part of a lamellar droplet structure either as the sole surfactant in the droplets, or more preferably in combination with other surfactant materials.

It is believed that it is well within the ability of the skilled person to detect the presence of such a non-solid dispersed phase, for example by light microscopy or electron microscopy.

For ensuring that a non-solid dispersed phase comprising the PAS materials is present, several parameters may be varied. Preferably one or more of the following conditions are fulfilled for incorporating the PAS into a non-solid phase:

(a) The mole ratio of sodium to other cationic counterions such as potassium and/or ammonium in the composition is from 10:1 to 1:10, more preferably from 3:1 to 1:3, most preferably from 2:1 to 1:2;

(b) The PAS material is a branched alkyl sulphate, wherein at least 20%, more preferably more than 30%, most preferably more than 50% of the PAS molecules are branched.

(c) The composition comprises a soap as part of the surfactant system, wherein preferably the soap is predominantly unsaturated. Especially preferably the iodine value of the soap is greater than 70, more preferably greater than 75, most preferably oleate soaps are used.

With respect to condition (a), it is believed that if compositions of the invention contain available counterions for the PAS other than sodium, this will generally lead to less crystallisation of the PAS and therefore generally to a lower viscosity and/or increased stability. Preferably compositions of the invention contain mixtures of sodium and other counterions. Preferably the other counterions are selected from the group of monovalent cations such as potassium, lithium and ammonium, more preferably the other counterions are potassium ions. The mole ratio of sodium to other counterions in the total composition is preferably from 10:1 to 1:10, more preferably from 3:1 to 1:3, most preferably from 2:1 to 1:2.

With respect to (b) preferably the PAS materials are at least partly branched, preferably at least 20% of the PAS molecules are branched, more preferably more than 30%, most preferably more than 50%. Branching is believed to be advantageous because it generally leads to less crystallisation of the PAS materials and therefore to a lower viscosity and/or increased stability.

The use of unsaturated soaps is believed to be advantageous, because this possibly provides a reduced formation of solid complexes of the soap and the PAS material and therefore results in a reduced viscosity and/or an increased stability.

Preferably at least two of the three above mentioned conditions are satisfied, especially conditions (a) and (b), most preferably all three conditions are satisfied.

The Liquid Detergent Product

Preferably compositions of the invention are physically stable. In the context of the present invention, physical stability for liquid systems of the invention can be defined in terms of the maximum separation compatible with most manufacturing and retail requirements. That is, the 'stable' compositions will yield no more than 5%, most preferred no more than 2% by volume phase separation as evidenced by appearance of 2 or more separate phases when stored at 25° C. for 21 days from the time of preparation. Especially preferred are compositions which do not yield any phase separation upon storage for 21 days at 25° C.

Preferably, compositions of the invention have a pH of between 6 and 14, more preferred from 6.5 to 13, especially preferred from 7 to 12.

Compositions of the invention preferably have a viscosity after storage for 2 weeks of less than 2,500 mPa.s at 21 s-1, more preferred less than 2,000 mPa.s, most preferred less than 1,500 mPa.s, especially preferred between 100 and 1,000 mPa.s at 21 s-1. Preferably these preferred viscosities are observed after storage for at least two weeks at 25° C., but more preferably also at 15° C. and most preferably also at 5° C. and 0° C.

Compositions of the invention comprise detergent active materials, preferably at a level of from 1 to 70% by weight of the composition, more preferred a level of 5 to 50% by weight, most preferred from 10 to 40% by weight.

Preferably at least 5% by weight of the detergent active materials are PAS materials, most preferably more than 10%, most preferably more than 20%. Preferably the PAS constitutes less than 60% by weight of the detergent active materials, more preferred less than 50%, most preferred less than 40%.

If for lamellar droplet structured liquid detergent compositions a blend of surfactants is used, the precise proportions of each component which will result in lamellar droplets will depend on the type(s) and amount(s) of the electrolytes, as is the case with. conventional structured liquids.

In the widest definition the detergent-active material may, in addition to the PAS material as described above, comprise one or more other surfactants, which may be selected from anionic, cationic, nonionic, zwitterionic and amphoteric species, and (provided mutually compatible) mixtures thereof. For example, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phospine oxides and dialkyl sulphoxides.

Other preferred nonionic surfactant materials are glyceryl ethers such as for example disclosed in GB 1,506,419.

Although compositions of the invention may be free of nonionic surfactants, generally the level of nonionic surfactants is more than 1% by weight of the composition, preferably from 2.0 to 25.0% by weight of the composition.

Compositions of the present invention may also contain synthetic anionic surfactant ingredients other than PAS. These other synthetic anionic surfactants are preferably used in combination with the above mentioned nonionic materials. Suitable synthetic anionic surfactants are usually water-soluble alkali metal salts of organic sulphonates having alkyl radicals containing from about 8 to about 22 carbon atoms, the term alkyl being used to include the alkyl portion of higher acyl radicals. Examples of suitable synthetic anionic detergent compounds are for example sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolyzing with a base to produce a random sulphonate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates.

Generally the level of non-soap, non-PAS anionic surfactant materials is from 0–35% by weight of the composition, for example from 0.5 to 25%.

It is also possible, and sometimes preferred, to include an alkali metal soap of a mono- or di-carboxylic acid, especially a soap of an acid having from 12 to 18 carbon atoms, for example oleic acid, ricinoleic acid, and fatty acids derived from castor oil, rapeseed oil, groundnut oil, coconut oil, palmkernel oil, alk(en)yl succinates e.g. dodecyl succinate or mixtures thereof. The sodium or potassium soaps of these acids are preferably used. Preferably the level of soap in compositions of the invention is from 0–40% by weight of the composition, more preferred from 5–25%.

As stated above, preferably the soap material is predominantly unsaturated and has a iodine value of at least 70 more preferably more than 75, most preferably the soap consists for at least 70% by weight of unsaturated soap materials such as oleate.

Preferably the weight ratio of anionic surfactants (including the PAS material and the soap material) to the above mentioned nonionic surfactant materials is from 10:1 to 1:10, more preferred from 5:1 to 1:2, most preferred from 4:1 to 1:2.

Also possible is the use of salting out resistant active materials such as for example described in EP 328 177, especially the use of alkyl poly glycoside surfactants such as for example disclosed in EP 70 074. Also alkyl mono glucosides may be used. Preferred levels of these materials are from 0–20% by weight, more preferably from 1 to 15%.

The compositions optionally also contain electrolyte, preferably in an amount sufficient to bring about lamellar droplet structuring of the detergent-active material. Preferably the compositions contain from 1% to 60%, especially from 2 to 45% of a salting-out electrolyte. Salting-out electrolyte has the meaning ascribed to in specification EP-A-79 646. Optionally, some salting-in electrolyte (as defined in the latter specification) may also be included. In selecting the appropriate level of salting-out electrolyte it is sometimes preferred to use relatively low amounts of salting-out electrolytes, say from 2–10% by weight. These levels are generally sufficiently high to provide structuring of the composition, and do not provide viscosity problems.

In any event, it is preferred that compositions according to the present invention include detergency builder material, some or all of which may be electrolyte. In this context it should be noted that some detergent active materials such as for example soaps, also have builder properties.

Examples of phosphorous-containing inorganic detergency builders include the water-soluble salts, especially alkali metalpyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used. Sometimes it is however preferred to minimise the amount of phosphate builders.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

Examples of organic detergency builders, when present, include the alkaline metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilitriacetic acid, oxydisuccinic acid, melitic acid, benzene polycarboxylic acids, CMOS, tartrate mono succinate, tartrate di succinate and citric acid. Citric acids or salts thereof are preferred builder materials for use in compositions of the invention.

Preferably the level of non-soap builder material is from 5–40% by weight of the composition, more preferred from 5 to 25% by weight of the composition.

In the context of organic builders, it is also desirable to incorporate polymers which are only partly dissolved, in the aqueous continuous phase as described in EP 301,882. Typical levels are from 0.5 to 4.5% by weight.

It is further possible to include in the compositions of the present invention, alternatively, or in addition to the partly dissolved polymer, yet another polymer which is substantially totally soluble in the aqueous phase. Use of such polymers is generally described in our EP 301,883. Typical levels are from 0.5 to 4.5% by weight.

Apart from the ingredients already mentioned, a number of optional ingredients may also be present, for example lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and, usually present in very minor amounts, fluorescent agents, perfumes, enzymes such as proteases, amylases and lipases (including Lipolase (Trade Mark) ex Novo), anti-redeposition agents, germicides and colourants.

A preferred further ingredient—which is especially preferred for incorporation in internally structured compositions according to the invention—is a deflocculating polymer e.g one having a hydrophilic backbone and at least one hydrophobic side chain. Such polymers are described in our copending British patent applications 8924479.2, 8924478.4 and 8924477.6 and in our European patent application EP 346 995. Typical levels of these ingredients are from 0.5 to 4.5% by weight.

Compositions of the invention may be prepared by any conventional method for the preparation of liquid detergent compositions. A preferred method involves the dispersing of the electrolyte ingredient—if any—together with the minor ingredients except for the temperature sensitive ingredients—if any—in water of elevated temperature, followed by the addition of the builder material—if any—, the detergent active materials (preferably as a non-aqueous premix containing the PAS in acid-form) under stirring and thereafter cooling the mixture and adding any temperature sensitive minor ingredients such as enzymes perfumes etc. The deflocculating polymer—if any—may advantageously be added after the electrolyte ingredients, the builder ingredients or just before cooling.

A particularly preferred method of making a aqueous liquid detergent composition which contains a PAS material is to use a premix of PAS with nonionic surfactants, said premix containing little or no water. Preferred premixes contain 10–50% by weight more preferrably 15–40% most preferably 20–35% of PAS, and 50–90% more preferably 60–80% of nonionic surfactant. The water level is preferably less than 20% by weight, more preferably less than 10% most preferably the premix is substantially free of water. The PAS in the premix may be present in acid form, but generally the PAS will be present in salt form for example in its sodium salt form.

The premixes can easily be handled and do not suffer from high viscosities. They can for example be supplied as a feedback raw material from as sulphonation or sulphation plant.

In use the detergent compositions of the invention will be diluted with wash water to form a wash liquor for instance for use in a washing machine. The concentration of liquid detergent composition in the wash liquor is preferably from 0.05 to 10%, more preferred from 0.1 to 3% by weight.

The invention will now be illustrated by way of the following Examples.

EXAMPLE I

The following compositions were made by adding the ingredients in the listed order to the water at a temperature of 40° C.

| COMPOSITION % wt | A | B | C | D | E | F |
|---|---|---|---|---|---|---|
| Sodium citrate.$2H_2O$ | 10 | 10 | 10 | 10 | 10 | 5 |
| Glycerol | 5 | 5 | 5 | 5 | 5 | 5 |
| Borax | 3.5 | 3.5 | 3.5 | 3.5 | 3.5 | 3.5 |
| Fluorescer | 0.1 | 0.1 | 0.1 | 0.1 | 0.1 | 0.1 |
| NaOH | 2.8 | 2.8 | — | 2.8 | 2.8 | — |
| KOH | — | — | 3.9 | — | — | 3.9 |
| polymer[1)] | 1.0 | 1.0 | 1.0 | 1.0 | 1.0 | 1.0 |
| Synperonic A7 | 20 | 20 | 20 | 20 | 20 | 20 |
| Oleic acid | 6 | 6 | 6 | 6 | 10 | 10 |
| Coconut fatty acid | 4 | 4 | 4 | 4 | — | — |
| Dobanol 91 PAS[2)] | 10 | — | — | — | — | — |
| Lial 145 PAS[3)] | — | 10 | 10 | — | 10 | 10 |
| Empicol PAS[4)] | — | — | — | 10 | — | — |
| Perfume | 0.4 | 0.4 | 0.4 | 0.4 | 0.4 | 0.4 |
| Antifoam (DB100) | 0.1 | 0.1 | 0.1 | 0.1 | 0.1 | 0.1 |
| water | ← | - | balance | | - | → |

notes:
[1)]polymer A-11 as described in EP 346 995 (100%)
[2)]A $C_9$–$C_{11}$ linear PAS ex Shell (as 100%, sodium salt)
[3)]A $C_{14}$–$C_{15}$ PAS being 60% branched ex Enichem (as 100%, sodium salt)
[4)]A coconut PAS ex A&W (as 100% ammonium salt).

The following product forms were obtained after storage for 2 weeks at the temperature indicated (L=liquid indicates a viscosity at 21 $s^{-1}$ of less than 2,500 mPa.s, P=Paste indicates a viscosity of more than 2,500 mPa.s at 21 $s^{-1}$):

| COMPOSITION | A | B | C | D | E | F |
|---|---|---|---|---|---|---|
| at 25° C. | L | L | L | L | L | L |
| at 15° C. | L/P | P | L | L | L | L |
| at 5° C. | P | P | P | P | P | L |
| at 0° C. | P | P | P | P | P | L |

This example illustrates that PAS containing compositions of satisfactory viscosity after storage at 25° C. can be obtained by using a Dobanol 91 or Lial 145 PAS (compositions A and B). Further viscosity benefits can be obtained by using mixed counterions (Compositions C and D) or by using unsaturated soap materials (Composition E), especially advantageous results can be obtained by using mixed counterions in combination with unsaturated soaps (Composition F).

EXAMPLE II

The following compositions were made as in example I

| COMPOSITION % wt | A | B | C | D | E |
|---|---|---|---|---|---|
| Glycerol | 5 | 5 | 5 | 5 | 5 |
| Borax | 3.5 | 3.5 | 3.5 | 3.5 | 3.5 |
| Fluorescer | 0.1 | 0.1 | 0.1 | 0.1 | 0.1 |
| Nacitrate.2aq | — | — | — | 10 | — |
| Citric acid.laq | 7.1 | 7.1 | 7.1 | — | 7.1 |
| NaOH | 4.7 | 2.4 | — | — | 2.4 |
| KOH | 3.3 | 6.6 | 10 | — | 6.6 |
| polymer[1)] | 1.0 | 1.0 | 1.0 | 1.0 | 1.0 |
| Synperonic A7 | 20 | 20 | 20 | 16 | 20 |
| Oleic acid | 10 | 10 | 10 | — | 10 |
| Lial 145[3)] | 10 | 10 | 10 | 24 | 10 |
| water | ← | - | balance | - | → |

[1)]polymer A-11 as described in EP 346 995 (100%)
[3)]A $C_{14}$–$C_{15}$ PAS being 60% branched ex Enichem (as 100%, sodium salt)

The following product forms were obtained after storage for 2 weeks at the temperature indicated (L=liquid indicates a viscosity at 21 $s^{-1}$ of less than 2,500 mPa.s, P=Paste indicates a viscosity of more than 2,500 mPa.s at 21 $s^{-1}$):

| COMPOSITION | A | B | C | D | E |
|---|---|---|---|---|---|
| at 20° C. | L | L | L | L | L |
| at 4° C. | L | L | L | P | L |
| at 0° C. | P | L | L | P | L |

This example illustrates that the viscosity after storage is less, when more potassium counterions are present (Compositions A–C). From compositions D–E it follows that higher levels of PAS may cause viscosity problems after storage.

EXAMPLE III

The compositions were made in the following way: A premix of PAS with nonionic surfactants was made. This premix had a water content of about 6%. Oleic acid was mixed with the premix.

Borax and citric acid and KOH were added to water under stirring followed by the addition of the Zeolyte, polymer, antifoam, the above active mix and the remaining ingredients. Oleic acid could equally well be added separately after addition of the blends.

| COMPOSITION % wt | A | B | C |
|---|---|---|---|
| Glycerol | 4.1 | 4.1 | 4.1 |
| Borax (10 aq) | 2.8 | 2.8 | 2.8 |
| Fluorescer | 0.1 | 0.1 | 0.1 |
| Nacitrate (anh.) | 6.7 | 6.7 | 6.7 |
| NaOH | 1.2 | 1.2 | 1.2 |
| KOH | 4.2 | 4.2 | 4.2 |
| Zeolite (4A type) | 15.0 | 15.0 | 15.0 |
| Polymer[1)] | 0.8 | 0.8 | 0.8 |
| Antifoam | 0.2 | 0.2 | 0.2 |
| Nonionic[5)] | 17.2 | 15.4 | 11.6 |
| Lial 123[6)] | 4.6 | 6.4 | 10.1 |
| Oleic acid | 6.3 | 6.3 | 6.3 |
| Perfume | 0.3 | 0.3 | 0.3 |
| Water | ← | - balance - | → |

[1)]polymer A-11 as described in EP 346 995 (100%).
[5)]Syperonic A7 and Syperonic A3 ex ICI in a 50:50 weight ratio mixture.
[6)]A C12–C13 PAS being 60% branched ex Enichem.

Of the above formulations the initial viscosity and the viscosity after 2 weeks was measured in mPa.s at 21 $s^{-1}$ at ambient temperature was measured, the softening temperature was measured and the Mole ratio of potassium to sodium was calculated. The following results were obtained:

| COMPOSITION | A | B | C |
|---|---|---|---|
| NI/PAS ratio | 3.7/1 | 2.4/1 | 1.15/1 |
| Mole ratio (K/Na) | 1.23/1 | 1.12/1 | 0.95/1 |
| Softening temperature (°C.) | <0 | <0 | <0 |
| Initial viscosity (mPa · s, 21 $s^{-1}$) | 815 | 770 | 1150 |
| Viscosity after 2 weeks of storage at 20° C. | 790 | 630 | 695 |

This example indicates that satisfactory viscosities of PAS-containing compositions can be obtained by using mixtures of non-ionics with PAS in different ratios, together with Zeolite.

EXAMPLE IV

The compositions were made in the following way: The ingredients were mixed in the listed order, with PAS added as the last active, followed by 20 minutes mixing.

| COMPOSITION % wt | A | B |
|---|---|---|
| Glycerol | 5 | 5 |
| Borax | 3.5 | 3.5 |
| Citric acid | 6.4 | 6.4 |
| Fluorescer | 0.1 | 0.1 |
| NaOH | 1.1 | 1.1 |
| KOH | 4.9 | 4.9 |
| Polymer | 1.0 | 1.0 |
| Syperonic A7 | 20 | 20 |
| Oleic acid | 10 | 10 |
| PAS[7)] | 4 | 6 |
| Perfume | 0.4 | 0.4 |
| Water | ← balance → | |

[7)]Empicol LXV, a sodium coconut PAS ex A&W.

| COMPOSITION | A | B |
|---|---|---|
| NI/PAS ratio | 5 | 3.7 |
| Mole ratio (K/Na) | 1.26 | 1.15 |
| Softening temperature (°C.) | <0 | 5 |
| Initial viscosity (mPa · s, 21 $s^{-1}$) | 240 | 270 |
| Viscosity after 2 weeks of storage at 20° C. | 195 | 195 |

This example shows that also with using a natural derived material, satisfactory compositions can be obtained.

We claim:

1. An aqueous liquid detergent composition having a viscosity of less than 2.5 Pas at 21 $s^{-1}$ after storage for two weeks at 15° C. or less and comprising from 5.0 to 60% by wt. of a primary alkyl sulfate material;

wherein the primary alkyl sulphate material is a branched sulphate in which at least 50% of the primary alkyl sulphate material is branched;

wherein the composition further comprises a unsaturated soap from 5 to 25% by wt. as part of the surfactant system, said soap having an iodine value of greater than 70; and wherein mole ratio of a first cationic counterion which is sodium to a second cationic counterion which is selected from the group consisting of potassium and ammonium in the composition is from 3:1 to 1:10.

2. An aqueous liquid detergent composition according to claim 1, comprising from 1 to 70% by weight of a detergent active material which material includes the 0.1 to 60% by weight primary alkyl sulphate.

3. An aqueous liquid detergent composition according to claim 2 comprising from 10 to 40% by weight of detergent active material wherein the primary alkyl sulphate is 0.1 to 40% by weight of the composition.

4. An aqueous liquid detergent composition according to claim 1 which is internally structured.

5. An aqueous liquid detergent composition according to claim 1, wherein the alkyl sulphate material is present in a lamellar droplet phase.

6. An aqueous liquid detergent composition according to claim 2, wherein the alkyl sulphate material constitutes from 5% to 60% by weight of the detergent active materials.

7. An aqueous detergent composition according to claim 1 comprising:

a) from 1–70% by weight of detergent active material, including the 0.1 to 60% by wt. primary alkyl sulfate;

b) from 1–60% of a salting out electrolyte;

c) from 0.1 to 40% of a primary alkyl sulfate; and d) from 0 to 4.5% of a deflocculating polymer.

* * * * *